United States Patent [19]

Gueble et al.

[11] Patent Number: 5,027,090

[45] Date of Patent: Jun. 25, 1991

[54] FILTER HAVING A DIELECTRIC RESONATOR

[75] Inventors: Jean-Michel Gueble, Plaisance Du Touch; Jean-Bernard Theron, Auzielle; Yannick Latouche, Legueuin; Jean-Bernard Ducrocq, Pechabou; Bernard Pérez, Saint Orens De Gameville, all of France

[73] Assignee: Alcatel Espace, Courbevoie, France

[21] Appl. No.: 508,445

[22] Filed: Apr. 13, 1990

[30] Foreign Application Priority Data

Apr. 13, 1989 [FR] France ..... 89 04906

[51] Int. Cl.[5] ..... H01P 1/20; H01P 7/10

[52] U.S. Cl. ..... 333/202; 333/219.1; 333/227

[58] Field of Search ..... 333/202, 208, 209, 212, 333/219, 219.1, 227, 230, 234

[56] References Cited

U.S. PATENT DOCUMENTS

| | | | |
|---|---|---|---|
| 3,562,665 | 2/1971 | Larrabee | 333/227 X |
| 4,563,661 | 1/1986 | O'Bryan, Jr. et al. | 333/219.1 X |
| 4,646,038 | 2/1987 | Wanat | 333/229 X |
| 4,661,790 | 4/1987 | Gannon et al. | 333/202 X |
| 4,667,172 | 5/1987 | Longshore et al. | 333/134 |
| 4,939,489 | 7/1990 | Guèble et al. | 333/219.1 X |
| 4,942,377 | 7/1990 | Ishikawa et al. | 333/202 |

FOREIGN PATENT DOCUMENTS

| | | | |
|---|---|---|---|
| 0173545 | 3/1986 | European Pat. Off. . | |
| 1591362 | 12/1970 | Fed. Rep. of Germany . | |
| 2047229 | 6/1971 | Fed. Rep. of Germany . | |
| 1427443 | 9/1988 | U.S.S.R. | 333/202 |
| 1520473 | 8/1978 | United Kingdom . | |

OTHER PUBLICATIONS

1982 IEEE MIT-S International Microwave Symposium Digest, Dallas, Tex., 15-17 Jun. 1982, pp. 386-388, IEEE New York, U.S.; S. J. Fiedziuszko et al.: "Miniature Filters and Equalizers Utilizing Dual Mode Dielectric Resonator Loaded Cavities".

Patent Abstracts of Japan, vol. 11, No. 99 (E-493) [2546], Mar. 27, 1987; & JP-A-251 202 (Fujitsu Ltd.) Nov. 8, 1986.

*Primary Examiner*—Eugene R. LaRoche
*Assistant Examiner*—Seung Ham
*Attorney, Agent, or Firm*—Sughrue, Mion, Zinn Macpeak & Seas

[57] ABSTRACT

A filter having a dielectric resonator, the filter comprising at least one cylindrical cavity (10) inside which there is a dielectric resonator (11) whose axis of symmetry (Δ) is colinear with the axis of symmetry of the cavity (10), the filter being characterized in that the resonator is held by a system of dished washers (15, 16). Applicable to microwave frequencies.

8 Claims, 3 Drawing Sheets

FILTER HAVING A DIELECTRIC RESONATOR

FIELD OF THE INVENTION

The invention relates to a filter having a dielectric resonator.

BACKGROUND OF THE INVENTION

Such a filter is based on the following principles:

- utilization of the modes of the screened dielectric resonator; and
- reutilization of conventional excitation methods and mode coupling methods, in particular by means of adjustment screws acting on the electric field.

An article published in "Electronics Letters", Vol. 16, No. 17, Aug. 14, 1980, pp. 646–647, entitled "Dielectric resonator dual mode filter" by P. Guillon, Y. Garault and J. Farenc describes a screened dielectric resonator which is cylindrical in shape in which a plurality of degenerative modes having identical natural frequencies may propagate. These degenerative modes may be coupled to one another in order to for form coupled circuits by disturbing the geometrical shape of the structure: thus, the frequency of the $TE_{01p}$ mode may be disturbed by means of a tuning screw, and it is possible to obtain a two-mode dielectric filter using the two perpendicularly polarized $HEM_{1,2,\Delta}$ modes of the resonator.

European patent application No. 0 064 799 describes a ceramic resonator element disposed in a cavity in order to form a composite microwave resonator. Two tuning screws situated along orthogonal axes inside the cavity serve to tune the assembly along these axes to frequencies close to the fundamental resonance frequency of the resonator element. A plurality of cavities of this type may be assembled together to form a filter by using a plurality of transverse separations.

The coupling between these various cavities may then be provided by means of single slots, by means of pairs of slots in a cross-configuration, or by means of circular irises. In each cavity an adjustment screw is disposed along an axis at 45° relative to the orthogonal turning screws so that resonance along one of the orthogonal axes is coupled to resonance along the other.

However these prior art documents give no details about:

- the position of the resonator inside the metal cavity;
- the materials used for the cavity, for the adjustment devices, and for the system holding the resonator; and
- the principle whereby the dielectric resonator is held inside the cavity.

In other prior art documents, some details are given concerning the materials used for the cavity:

- utilization of invar and carbon fiber; or
- utilization of some other material with the expansion coefficients involved being compensated.

As for the dielectric used for holding, few precise solutions are given, e.g.:

- low loss insulating materials in the form of a column or a cushion (foam, polystyrene of PTFE (polytetrafluoroethylene)).

While making it possible to optimize the response curves of dielectric resonator filters in a band close to resonance and over a wide band, the object of the invention is to solve the various questions raised in the making of such filters.

SUMMARY OF THE INVENTION

To this end, the invention provides a dielectric resonator filter comprising at least one cylindrical cavity having a dielectric resonator located therein with its axis of symmetry being colinear with the axis of symmetry of the cavity, the filter being characterized in that the resonator is held in place by a system of two dished washers.

Advantageously, the resonator is cylindrical resonator occupying a longitudinal symmetrical position inside the cavity.

Such a filter presents numerous advantages, namely:

- it makes it possible to obtain a sufficiently large frequency difference between the $HEM_{1,2\Delta}$ mode, for example, and the others modes for obtaining a relatively wide band free from parasitic modes; and
- it enables filters to be made having a structure which is more than two-mode.

More particularly, the invention relates to a dielectric resonator filter in which:

- the resonator is held by a system of dished washers resting against the inside wall of the cavity via a small rim at one end and using four lock screws bearing against a conical portion of the top washer. This ensures that the resonator is held in place in sprite of differential expansion.

Advantageously, the system of washers may be constituted by two cylindrical parts:

- a first part terminating at a first end in a conical bearing surface and at second end in four bearing surfaces for engaging the resonator; and
- a second part having one end engaging the resonator and identical to the first part, and having a simple bearing surface at its other end for bearing against the rim of the cavity.

Advantageously, the system is made of dielectric material and the cavity is made of silver-plated aluminum.

These characteristics make it possible:

- to optimize the Q-factor (no lossy material in critical zones); and
- to obtain a temperature stability coefficient of about 1 ppm/°C. (parts per million per degree centigrade), which can be compensated by using a dielectric resonator having a coefficient of −1 ppm/°C.

In addition, in such a filter, it is possible to use cylindrical resonators that do not require special machining, the system having the advantage of being very simple to implement, thereby constituting a major industrial advantage when a large number of channels is used, as in a multiplexer, for example.

BRIEF DESCRIPTION OF THE DRAWINGS

The characteristics and advantages of the invention appear more clearly from the following description given by way of non-limiting example and with reference to the accompanying drawings, in which.

DESCRIPTION OF THE PREFERRED EMBODIMENT

Figure 1:
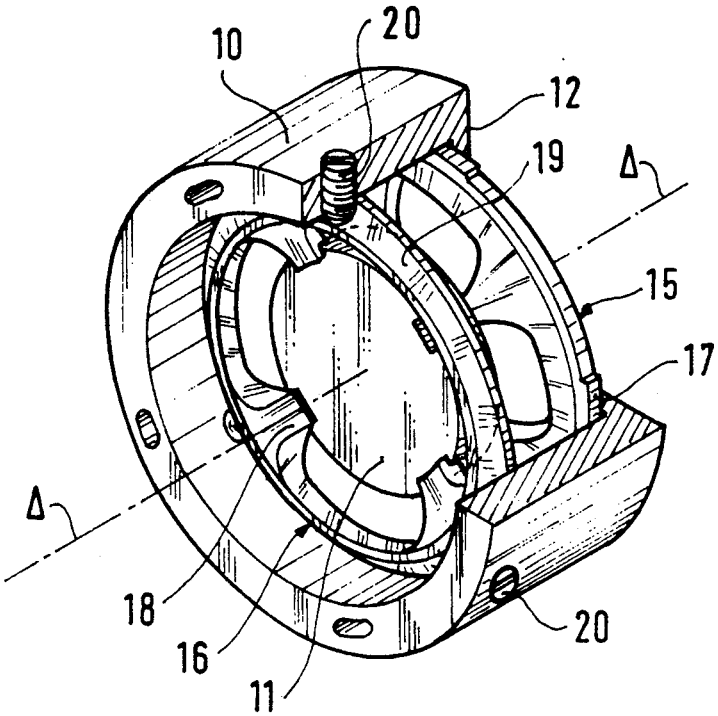
FIGS. 1 and 2 show how a resonator is mounted in a cavity, with FIG. 1 being a partially cut-away perspective view and FIG. 2 being a fragmentary exploded view.
Figure 2:
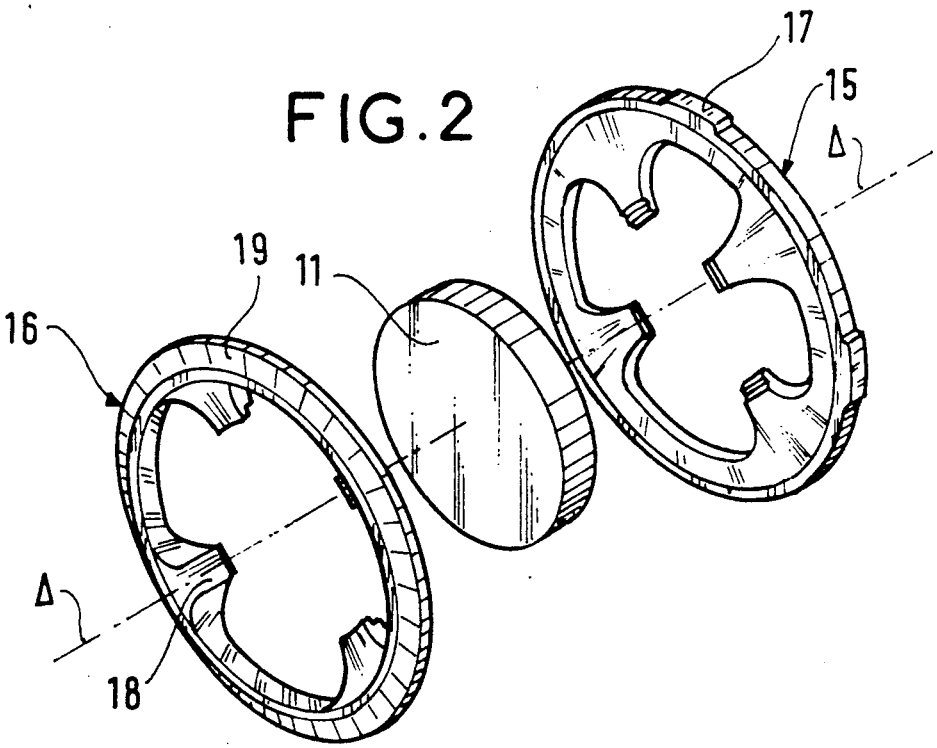

As shown in FIGS. 1 and 2, the resonator filter of the invention comprises a member having a cylindrical cavity 10 having a dielectric resonator 11 inside it, the resonator being cylindrical in shape, for example, with its axis of symmetry Δ being colinear with the axis of symmetry of the said cavity 10. In this case, the resonator 11 is disposed in a symmetrical position inside the cavity 10. The cavity 10 may also be closed, if necessary, by two irises.

The resonator 11 is held inside the cavity 10 by a system of dished washers 15 and 16. As shown in FIG. 1, the first washer 15 is mounted to bear against a rim 12 made on the inside wall of the cavity 10. The bearing surfaces of the washer 15 against the rim 12 of the cavity 10 are limited to studs 17 which are accurately machined. The resonator 11 bears against four bearing surfaces 18 made on the inside of the washer 15 and serving to hold the resonator in a symmetrical position on the axis Δ of the cavity 10.

The second washer 16 is very similar in shape to the first washer 16 and has four identical bearing surfaces 18 for engaging the resonator 11. It differs in that it has a conical bearing surface 19 which engages the pointed ends of lock screws 20 passing through the cavity 10 and serving to hold the resonator 11 in place in the cavity 10 by the contact they make.

In order to ensure that the resonator 11 occupies a stable position inside the cavity 10, compensation for thermal expansion of the materials used is ensured by the resilience of the washers 15 and 16, given that a degree of prestress is applied to them on assembly.

By way of example, the device of the invention may make use of cavities and adjustment devices made of silver-plated aluminum.

In one embodiment, the filter of the invention satisfies the folowing characteristics:

the resonator 11 is held by a washer system (15, 16) which applies a stress designed to withstand accelerations of up to 30 g and considerable thermal stresses.

Figure 3:
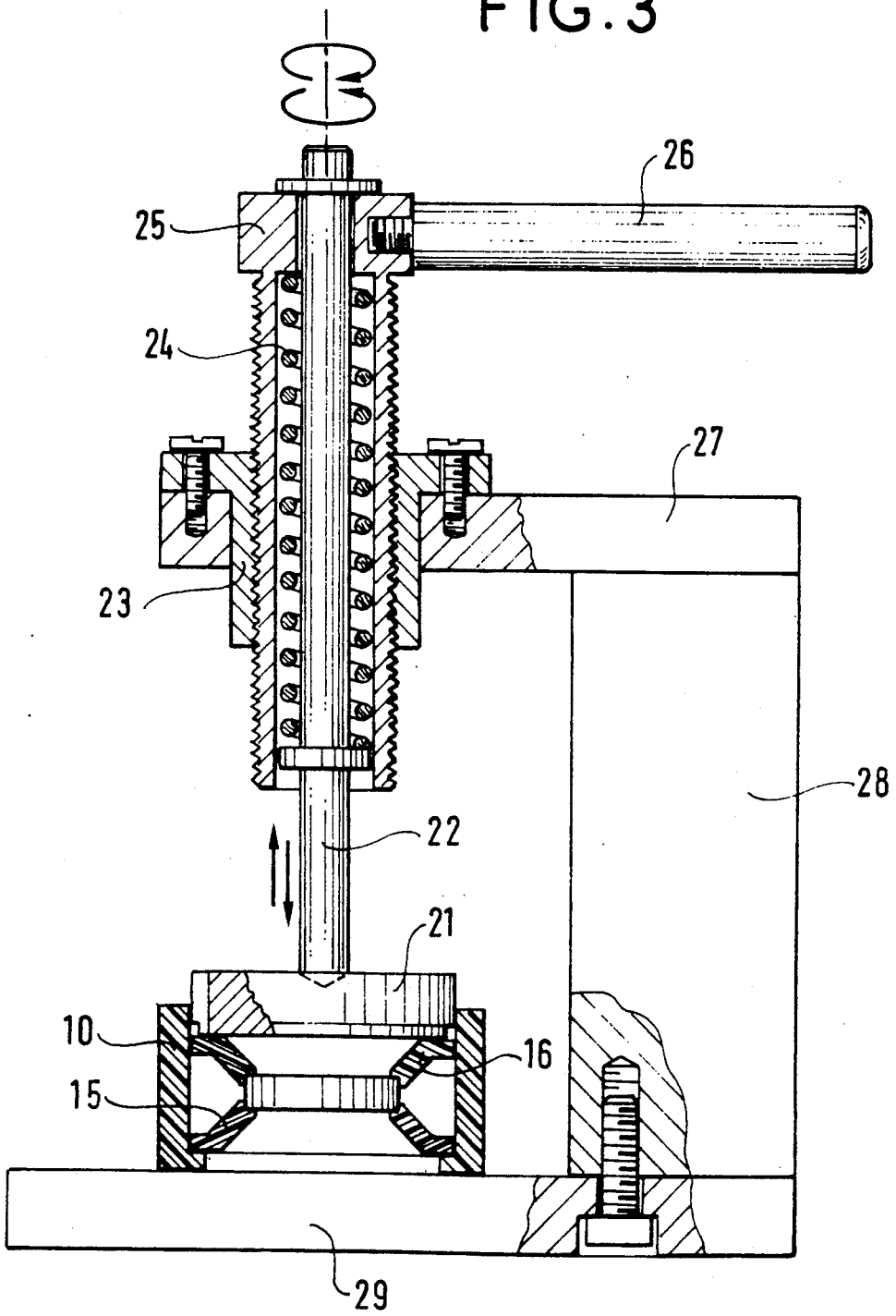
FIG. 3 shows the method of assembly used for applying prestress.

This prestress is applied by means of the tooling shown in FIG. 3, the tooling comprising a frame 27, 28, 29 having a guide 25 fixed thereto.

A spring 24 is imprisoned inside the guide 25 and the force set by the spring is transmitted by a finger 22 and a plate 21 to the top washer 16. The spring is compressed as a function of the number of turns of a lever 26. The tooling is calibrated to establish the relationship between number of turns and the force.

The lock screws 20 are then put into position so they bear against the conical bearing surface 19 of the second washer 16 before raising the finger 22.

Figure 4:
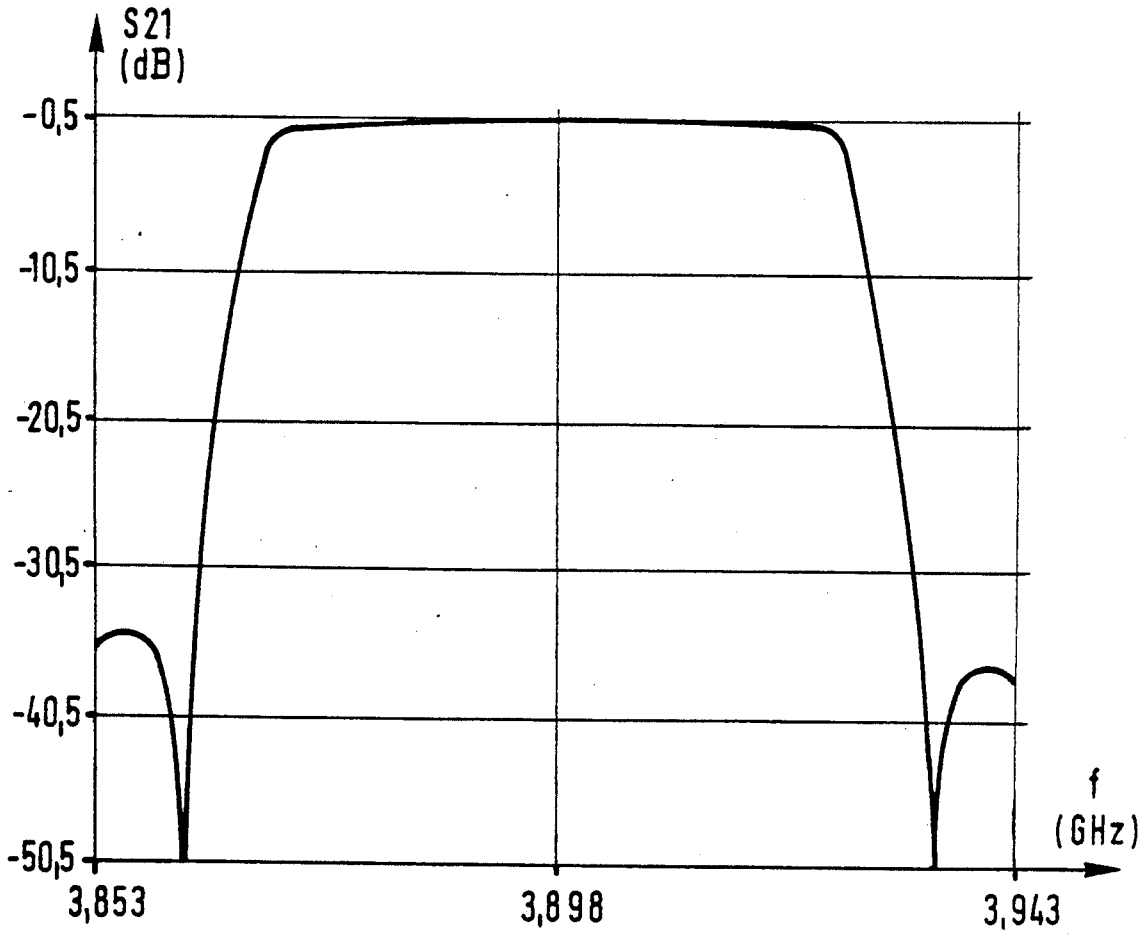
FIG. 4 shows a response curve of a particular embodiment of a filter of the invention.

By way of worked example, the component parts of the filter of the invention may have the following dimensions:

resonator 11:
- diameter 21 mm
- length 5 mm cavity 10:
- inside diameter 26 mm
- length 21 mm position of the resonator inside the cavity: centered;

and materials used:
- cavity made of aluminum
- iris made of aluminum
- fixing made of dielectric A plurality of cavities of the invention may be connected end to end in order to constitute an n-pole filter. Thus, by using four cavities having the above-defined characteristics and putting them end to end, it is possible to provide an eight-pole filter which is self-correcting in the 3.7 GKz to 4.2 GKz band and which provides the performance shown by the curve in FIG. 4 where its transfer parameter is plotted as gain in decibels as a function of frequency in gigahertz.

Endurance tests applied to this assembly have shown that it is very reliable (suitable for use in space applications).

Naturally the present invention has been described and shown merely by way of prefered example and its component parts could be replaced by equivalent parts without going beyond the scope of the invention.

What is claimed is:

1. A filter comprising at least one member having a cylindrical cavity (10) having an axis of symmetry, a dielectric resonator (11) inside said cavity (10) having an axis of symmetry (Δ) colinear with the axis of symmetry of the cavity (10), first and second washers (15, 16) having opposite axial ends holding said resonator in said cavity;

said first washer (15) being terminated at a first end by studs (17) bearing axially against a rim (12) formed on the inside wall of the cavity (10) and at a second axial end by a plurality of circumferentially separated surfaces (18) bearing axially against the resonator (11);

said second washer (16) being terminated at a first axial end by a radially internal conical surface (19) bearing lock screws passing through the cavity defining member and holding the resonator (11) in place in the cavity, and at a second axial end by a plurality of circumferentially separate surfaces (18) bearing axially against the resonator (11).

2. A filter according to claim 1, wherein the dielectric resonator (11) is cylindrical in shape.

3. A filter according to claim 1, wherein the resonator (11) occupies a longitudinally symmetrical position inside the cavity (10).

4. A filer according to claim 1, wherein the resonator (11) is disposed between two washers (15, 16) bearing against radially inwardly projecting, circumferentially spaced separate bearing surfaces (18).

5. A filter according to claim 4, wherein the washers (15, 16) are perforated.

6. A filter according to claim 1, said washers are prestressed.

7. A filter according to claim 1, wherein the washers (15, 16) are made of dielectric material.

8. A filter according to claim 1, wherein the member forming cavity (10) is made of silver-plated metal.

* * * * *